US011127513B2

(12) United States Patent
Ooshima et al.

(10) Patent No.: US 11,127,513 B2
(45) Date of Patent: Sep. 21, 2021

(54) CONDUCTING WIRE AND COIL MEMBER

(71) Applicant: DENSO CORPORATION, Kariya (JP)

(72) Inventors: Hisayoshi Ooshima, Kariya (JP); Jyunichi Naruse, Kariya (JP); Hidehiko Hiramatsu, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 17/004,156

(22) Filed: Aug. 27, 2020

(65) Prior Publication Data

US 2021/0065930 A1 Mar. 4, 2021

(30) Foreign Application Priority Data

Aug. 28, 2019 (JP) ..... JP2019-155639

(51) Int. Cl.
*H01B 7/02* (2006.01)
*H01B 7/18* (2006.01)
*H01B 1/04* (2006.01)

(52) U.S. Cl.
CPC ..... *H01B 7/188* (2013.01); *H01B 1/04* (2013.01)

(58) Field of Classification Search
CPC . H01B 1/04; H01B 3/30; H01B 3/308; H01B 3/40–3/47; H01B 7/02; H01B 7/0216–7/0225; H01B 7/0258; H01B 7/04; H01B 7/08; H01B 7/186; H01B 7/188
USPC .... 174/110 R, 110 A–110 PM, 117 R, 117 F, 174/117 FF
See application file for complete search history.

(56) References Cited

U.S. PATENT DOCUMENTS 3,396,230 A * 8/1968 Crimmins ..... H01B 13/10 174/72 B
3,549,926 A * 12/1970 Pentland ..... H02K 3/325 310/194
3,639,680 A * 2/1972 Dempsey, Jr. ..... H02G 5/06 174/117 FF
3,723,797 A * 3/1973 Andersson ..... H01B 3/105 310/196
3,819,443 A * 6/1974 Simons ..... B32B 27/322 156/204
3,902,938 A * 9/1975 Eller ..... H01B 13/106 156/54
5,393,933 A * 2/1995 Goertz ..... H01B 7/0018 174/102 R
6,080,935 A * 6/2000 Lanoue ..... H01F 41/063 174/117 F
2004/0149485 A1* 8/2004 Edwards ..... B64G 1/648 174/117 R
2011/0110843 A1 5/2011 Pasquali et al.
(Continued)

FOREIGN PATENT DOCUMENTS

JP 2008-108583 A * 5/2008 ..... H01B 5/14
JP 2015-176733 A 10/2015
JP 2017-191700 A 10/2017

*Primary Examiner* — William H. Mayo, III
(74) *Attorney, Agent, or Firm* — Posz Law Group, PLC

(57) ABSTRACT

A conducting wire includes a conducting wire element. The conducting wire element includes a conductor made of carbon as a main component and extending along a longitudinal direction and an insulator connected to the conductor and extending along a longitudinal direction. The insulator includes a core made of a material that is more plastically deformable than the conductor and a first adhesive made of an insulating material, disposed on the core, and joined to one side of the conductor.

10 Claims, 4 Drawing Sheets

(56) References Cited

U.S. PATENT DOCUMENTS

| | | | | |
|---|---|---|---|---|
| 2012/0298395 | A1* | 11/2012 | Gundel ..... | H01R 13/5845<br>174/105 R |
| 2014/0131096 | A1 | 5/2014 | Silverman et al. | |
| 2017/0236621 | A1 | 8/2017 | Silverman et al. | |
| 2018/0240569 | A1 | 8/2018 | Richmond et al. | |

* cited by examiner

CONDUCTING WIRE AND COIL MEMBER

CROSS REFERENCE TO RELATED APPLICATION

This application is based on Japanese Patent Application No. 2019-155639 filed on Aug. 28, 2019, the disclosure of which is incorporated herein by reference in its entirety.

TECHNICAL FIELD

The present disclosure relates to a conducting wire including a conductor made of carbon as a main component; and a coil member.

BACKGROUND

A conducting wire includes a conductor made of carbon nanotubes as a main component. Specifically, the conducting wire is constituted such that the conductor is arranged on a sheet made of polyethylene terephthalate (i.e., PET) or the like. The conducting wire is formed by spraying carbon nanotubes containing a binder and a dispersant through a nozzle onto the sheet.

SUMMARY

A conducting wire includes a conducting wire element. The conducting wire element includes a conductor made of carbon as a main component and extending along a longitudinal direction and an insulator connected to the conductor and extending along the longitudinal direction. The insulator includes a core made of a material that is more plastically deformable than the conductor and a first adhesive made of an insulating material, disposed on one side of the core, and joined to the conductor.

DETAILED DESCRIPTION

To begin with, examples of relevant techniques will be described.

A conducting wire includes a conductor made of carbon nanotubes as a main component. Specifically, the conducting wire is constituted such that the conductor is arranged on a sheet made of polyethylene terephthalate (i.e., PET) or the like. The conducting wire is formed by spraying carbon nanotubes containing a binder and a dispersant through a nozzle onto the sheet.

In recent years, a conducting wire improved in a versatility has been desired.

It is objective of the present disclosure to provide a conducting wire and a coil member improved in a versatility.

A conducting wire includes a conducting wire element. The conducting wire element includes a conductor made of carbon as a main component and extending along a longitudinal direction and an insulator connected to the conductor and extending along the longitudinal direction. The insulator includes a core made of a material that is more plastically deformable than the conductor and a first adhesive made of an insulating material, disposed on one side of the core, and joined to the conductor.

The insulator includes the core that is easily plastically deformable. Thus, the conducting wire can be kept in an arbitrary shape, so that the versatility is improved.

The insulator includes the first adhesive and the first adhesive is joined to the conductor. Therefore, the conductor and the insulator can be integrally formed by being separately prepared and then joined together. In this case, because the conductor does not necessarily contain a binder or dispersant, a resistance of the conductor can be reduced. That is, it is possible to use a conductor having an optimal orientation according to applications or a conductor having low resistance. Therefore, the versatility is further improved.

A coil member includes multiple wound portions that are adjacent to each other. The conducting wire is wound around the wound portions to constitute the multiple coils and a portion of the conducting wire serves as a connecting wire that connects adjacent ones of the multiple coils.

The coil member can be formed with the above-mentioned conducting wire. In this case, a shape and quality of the conducting wire can be easily altered according to a use and shape of a member in which the coil member is disposed, thus the versatility can be improved.

Hereinafter, embodiments of the present disclosure will be described with reference to the drawings. In the respective embodiments described herein, identical or equivalent parts are given identical reference numbers.

First Embodiment

Figure 1:
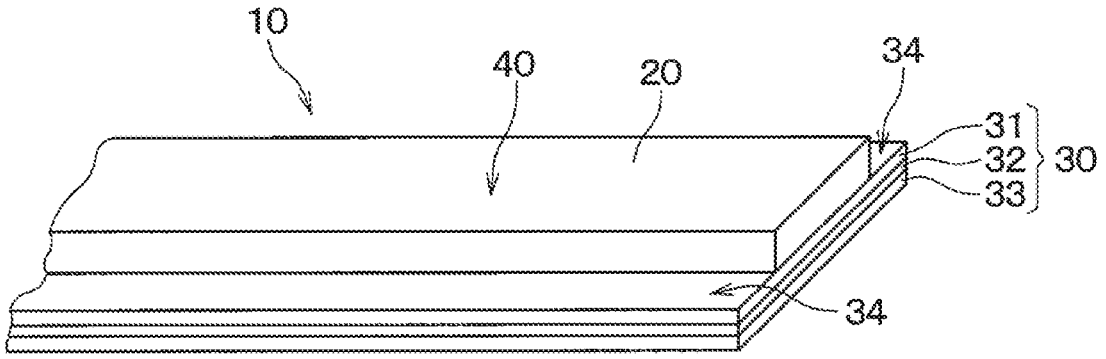
FIG. 1 is a perspective view of a conducting wire in a first embodiment.

A first embodiment will be described with reference to the drawings. As shown in FIG. 1, in this embodiment, a conducting wire 10 includes a conducting wire element 40. The conducting wire element 40 has a conductor 20 and an insulator 30.

The conductor 20 is made of carbon as a main component, specifically carbon nanotubes in this embodiment. The conductor 20 extends in a longitudinal direction and has a cross section, taken along a normal direction of the longitudinal direction, having at least one side. In FIG. 1, a right-left direction corresponds to the longitudinal direction. In this embodiment, the conductor 20 has a rectangular shape having long sides in the cross section. The carbon nanotubes forming the conductor 20, for example, have an orientation degree of 80%, do not include a binder or a dispersant, and do not have an adherence property. The conductor 20 is made by forming a carbon nanotube tape using a carbon nanotube dispersion containing a chlorosulfonic acid as a dispersant.

The insulator 30 is constituted such that a first adhesive 31, a core 32, and a second adhesive 33 are stacked in this order. The insulator 30 extends in a longitudinal direction and has a rectangular shape having long sides in a cross section taken along the normal direction of the longitudinal direction, similarly to the conductor 20.

The first adhesive 31 and the second adhesive 33 may be made of an acrylic adhesive. The core 32 is made of a material that is more plastically deformable than the conductor 20 such as polyethylene terephthalate. Such insulator 30 may be a double sided tape manufactured by TERAOKA SEISAKUSHO CO., LTD. The double sided tape includes a polyethylene terephthalate serving as the core 32 therein.

The first adhesive 31 is joined to the conductor 20 such that the longitudinal direction of the insulator 30 is parallel with the longitudinal direction of the conductor 20. That is, the insulator 30 is joined to the conductor 20 by adhering the first adhesive 31 to the conductor 20.

When a direction perpendicular to both the longitudinal direction and a stacking direction in which the conductor 20 and the insulator 30 are stacked with each other is defined as a width direction, the insulator 30 has a length in the width direction that is longer than that of the conductor 20. The width direction is also referred as a direction along longitudinal sides of the conductor 20 and the insulator 30 in the cross section. In this embodiment, the first adhesive 31, the core 32, and the second adhesive 33 have the same width.

The insulator 30 is joined to the conductor 20 such that both ends of the insulator 30 in the width direction protrude from the conductor 20. That is, the both ends of the insulator 30 are not joined to the conductor 20. Hereinafter, portions of the insulator 30 protruding from the conductor 20 in the width direction are referred to as ear portions 34. Each of the ear portions 34 has, for example, a length of 1 mm in the width direction, but a length of each of the ear portions 34 may be appropriately altered according to a thickness of the conductor 20 and a shape of the conducting wire 10 described later. The thickness of the conductor 20 is a length of the conductor 20 in the stacking direction of the conductor 20 and the insulator 30.

Hereinbefore, the configuration of the conducting wire 10 in this embodiment was described. Hereinafter, various examples of shapes of the conducting wire 10 will be described.

First Embodiment

The conducting wire 10 in the first embodiment will be described. In the first embodiment, the conducting wire element 40 shown in FIG. 1 is used as it is as the conducting wire 10.

Second Embodiment

Figure 2:
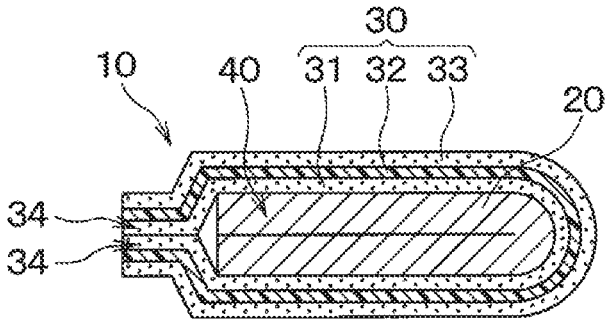
FIG. 2 is a cross-sectional view of a conducting wire in a second embodiment.

A conducting wire 10 in a second embodiment will be described. As shown in FIG. 2, the conducting wire 10 is constituted such that the conducting wire element 40 is folded back, together with the conductor, along the longitudinal direction. As a result, a first part of the conductor and a second part of the conductor are overlapped with each other so that the first part is in contact with the second part. In addition, the ear portions 34 of the insulator 30 are joined with each other, so that the conductor 20 of the conducting wire 10 is covered by the ear portions 34. Thus, a length of the conducting wire in the width direction can be reduced.

Third Embodiment

Figure 3:
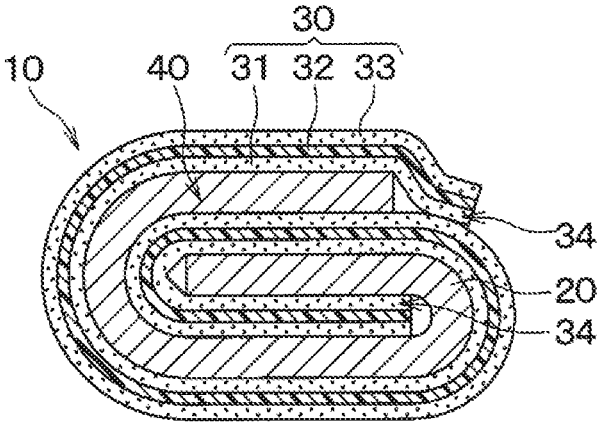
FIG. 3 is a cross-sectional view of a conducting wire in a third embodiment.

A conducting wire 10 in a third embodiment will be described. As shown in FIG. 3, the conducting element 40 is repeatedly folded back multiple times along the longitudinal direction into a substantially spiral shape in the cross section. Specifically, the conducting wire 10 is formed by folding back the conducting wire element 40 such that one of the ear portions 34 of the conducting wire element 40 is interposed by a first part of the conductor 20 and a second part of the conductor 20, and the other of the ear portions 34 is joined to a part of the insulator 30 that is exposed to an outside. As a result, the conductor 20 is covered. Thus, a length of the conducting wire in the width direction can be reduced.

Fourth Embodiment

Figure 4:
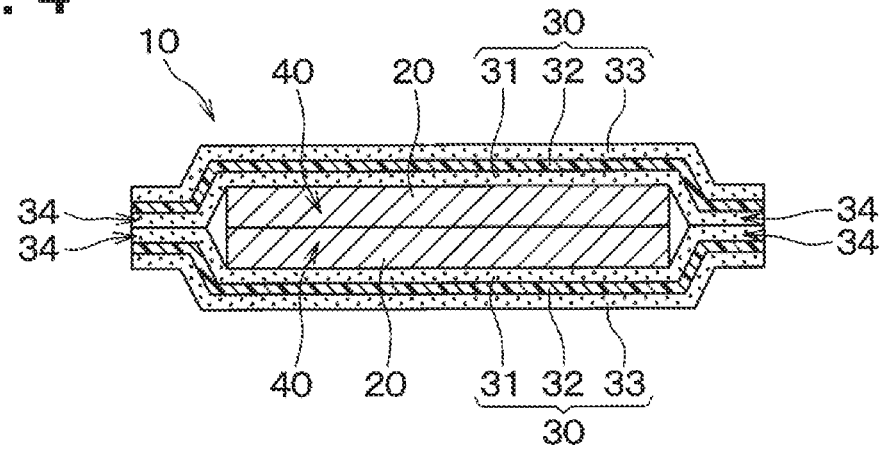
FIG. 4 is a cross-sectional view of a conducting wire in a fourth embodiment.

A conducting wire 10 in a fourth embodiment will be described. As shown in FIG. 4, the conducting wire 10 is formed by joining two conducting wire elements 40 together. Specifically, the conductors 20 of the conducting wire elements 40 are disposed to face, and be in contact with, each other. Additionally, the ear portions 34 facing each other of the two conducting wire elements 40 are joined together. As a result, the conductors 20 are covered. In this embodiment, the conducting wire 10 can increase an electric current passage.

Fifth Embodiment

Figure 5:
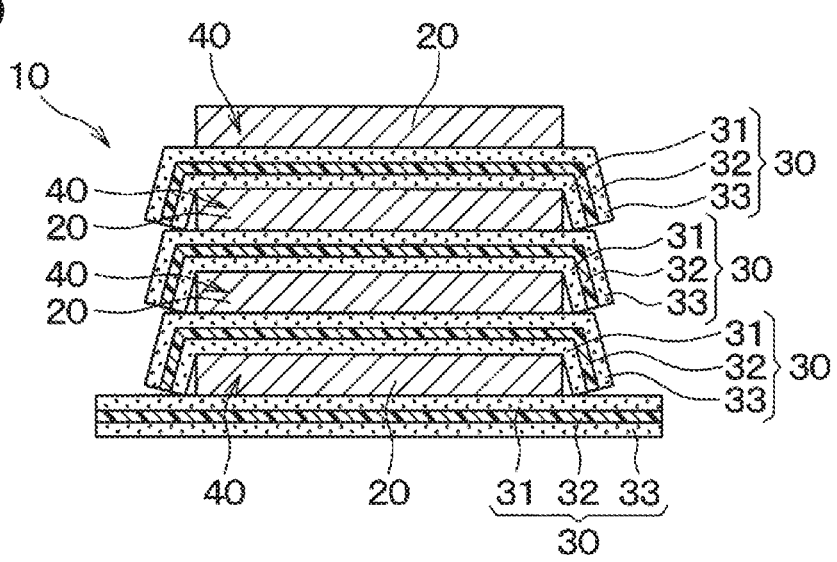
FIG. 5 is a cross-sectional view of a conducting wire in a fifth embodiment.

A conducting wire 10 in a fifth embodiment will be described. As shown in FIG. 5, the conducting wire 10 is formed by stacking multiple conducting wire elements 40. Specifically, the conductor 20 of lower one, in the stacking direction, of the adjacent conducting wire elements 40 is joined to the second adhesive 33 of upper one, in the stacking direction, of the adjacent conducting wire elements 40. The ear portions 34 of the upper one of the adjacent conducting wire elements 40 is joined to the ear portions 34 of the lower one of the adjacent conducting wire elements 40 to cover side surfaces of the conductor 20 of the lower one. As a result, the conductor 20 is covered.

Figure 6:
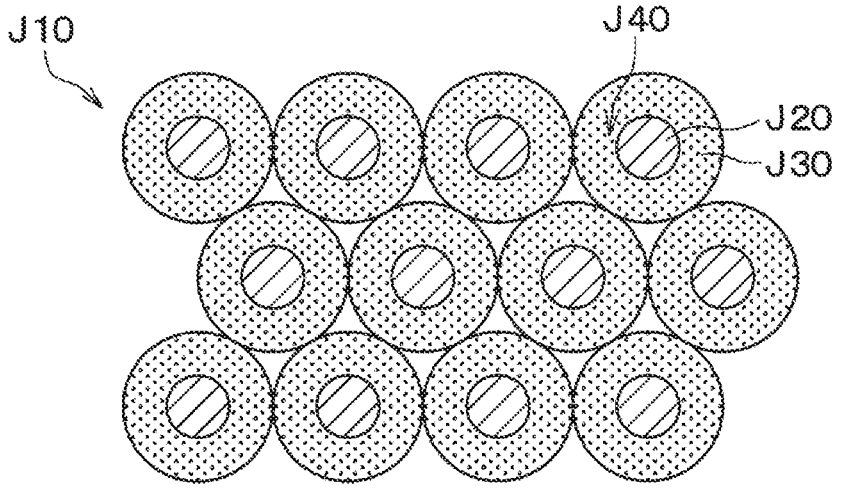
FIG. 6 is a cross-sectional view of a conducting wire in a comparative example against the conducting wire in the fifth embodiment.

For a comparative example, as shown in FIG. 6, a conducting wire 10 includes multiple conducting wire elements J40 each of which includes a conductor J20 and an insulator J30. The conducting wire element J40 has a circular shape in a cross section in which a longitudinal direction is a normal direction. The multiple conducting wire elements J40 are arranged to configure the conducting wire 10. In this case, when the conducting wire 10 in the fifth embodiment has the same area in the cross section as the conducting wire J10, an area of the insulator 30 disposed between the conductors 20 can be reduced in the fifth embodiment. As a result, the conductor 20 in FIG. 6 has a higher occupancy than the conducting wire J10. Thus, the conducting wire having high-performance can be provided.

Sixth Embodiment

Figure 7:
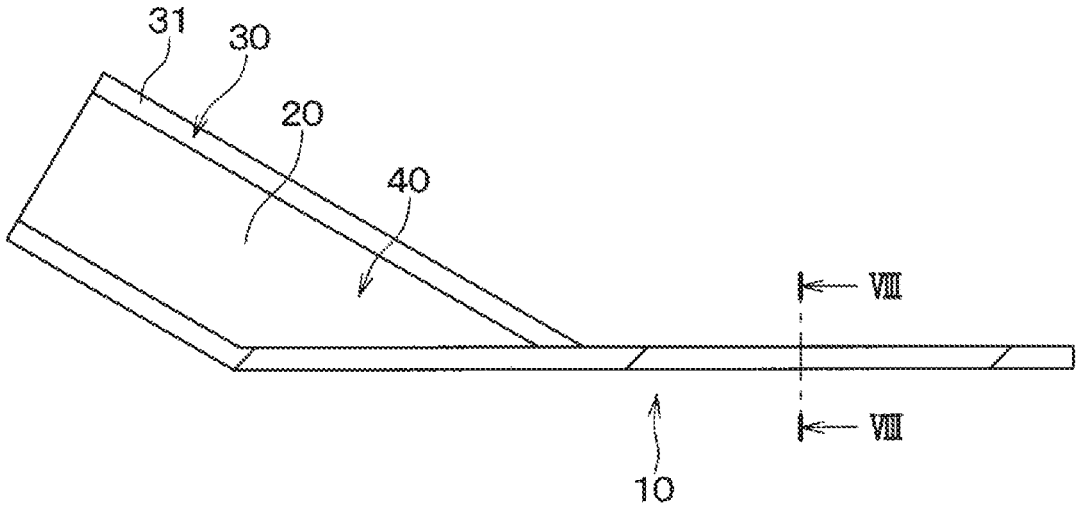
FIG. 7 is a perspective view of a conducting wire in a sixth embodiment.
Figure 8:
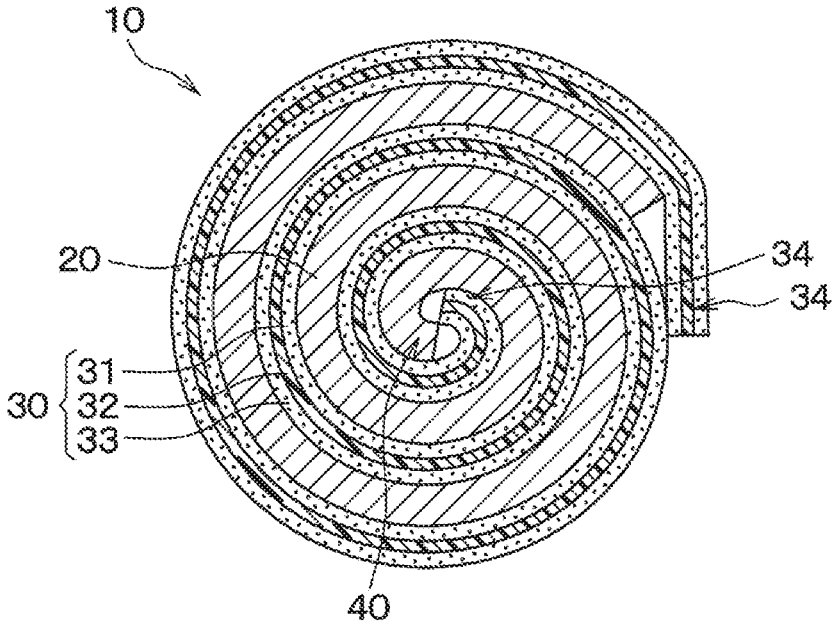
FIG. 8 is a cross-sectional view taken along a line VIII-VIII in FIG. 7.

A conducting wire 10 in a sixth embodiment will be described. As shown in FIGS. 7 and 8, the conducting wire 10 is constituted such that the conducting wire element 40 is wound around an axis along a direction intersecting the longitudinal direction. That is, the conducting wire 10 has a shape of a twisted thread. The conducting wire 10 can reduce a length in the width direction.

Seventh Embodiment

Figure 9:
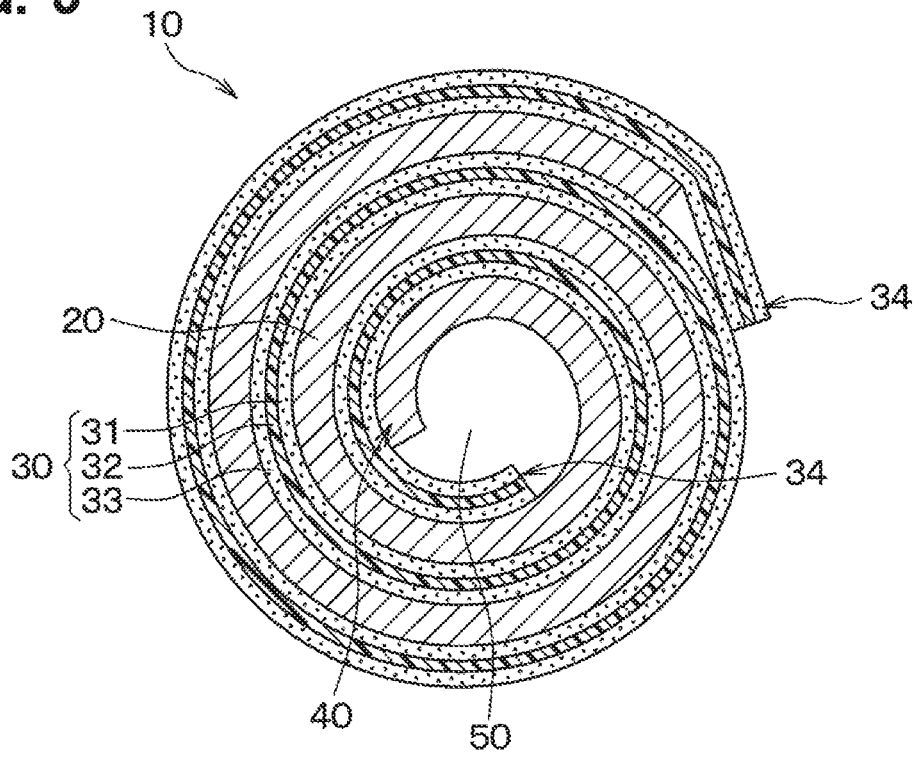
FIG. 9 is a cross-sectional view of a conducting wire in a seventh embodiment.

A conducting wire 10 in a seventh embodiment will be described. As shown in FIG. 9, the conducting wire 10 defines a hollow space 50 in the conducting wire 10 in the sixth embodiment. The conducting wire 10 in the seventh embodiment is formed by winding the conducting wire element 40 around a supporter that has a stick shape (not shown) and then removing the supporter.

The hollow space 50 can serve as a passage through which a heat-exchange medium such as a gas and a liquid for cooling flows. The seventh embodiment may be combined with the third embodiment and the conducting wire 10 in the third embodiment may define a hollow space 50 therein.

As described above, the conducting wire 10 can be modified into various shapes. The conducting wire 10 is appropriately altered based on a shape of a member in which the conducting wire 10 is mounted and a surrounding space. Thus, the versatility is improved.

Figure 10:
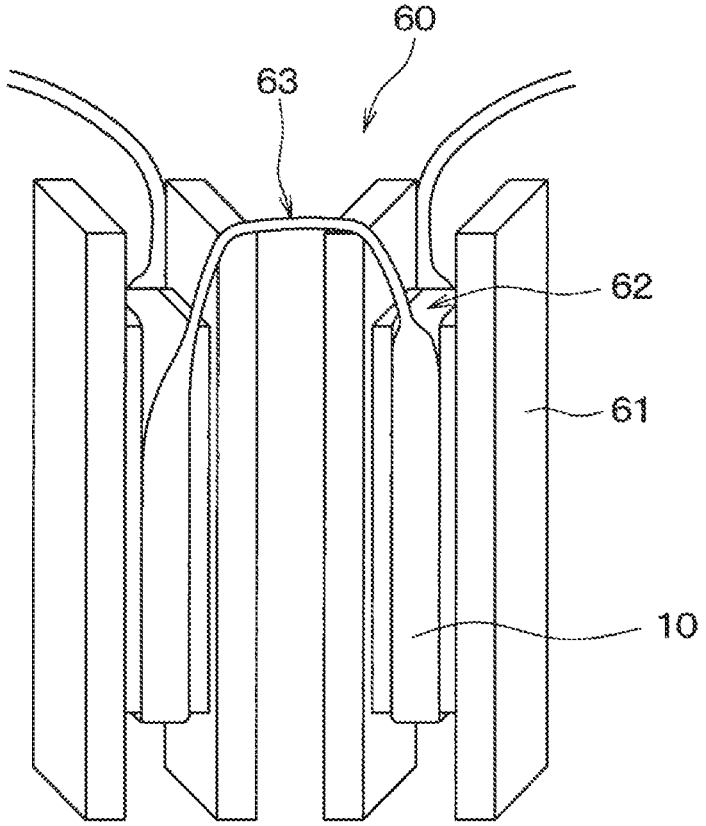
FIG. 10 is a schematic view of a stator in which the conducting wire is disposed.

For example, in FIG. 10, the conducting wire 10 is mounted in a stator 60 to constitute a coil member. Specifically, the stator 60 includes multiple stator cores 61 and each of the stator cores 61 includes a coil 62. The adjacent ones of the coils 62 of the stator cores 61 are connected each other with a connecting wire 63 as a crossover portion. In this embodiment, each of the stator cores 61 corresponds to a wound portion.

In this case, the coil 62 may be constituted by winding the conducting wire 10 in the first embodiment in FIG. 1 around the stator core 61. Specifically, the conducting wire 10 is wound around the stator core 61 such that the second adhesive 33 faces the stator core 61 and the second adhesive 33 is adhered to the stator core 61 or the conducting wire 10 located between the second adhesive 33 and the stator core 61. The insulator 30 of the conducting wire 10 includes the ear portions 34. Thus, even if the conducting wire 10 is slightly displaced while being wound around the stator core 61, a first part of the conductor 20 is restricted from being in contact and being electrically connected with a second part of the conductor 20. Because the conductor 20 is exposed to an outside at the outermost side of the coil 62, an insulator may be disposed to cover the conductor 20, if necessary.

The connecting wire 63 may be constituted such that the conducting wire 10 in the sixth embodiment in FIGS. 7 and 8 connects the adjacent ones of the coils 62. Thus, the connecting wire 63 can reduce a spatial limitation in the width direction. That is, the connecting wire 63 can be positioned in a minute space.

The coils 62 and the connecting wire 63 are constituted by one conducting wire 10 in this embodiment, but may be configured by multiple conducting wires 10. The shape of the conducting wire 10 disposed in the stator 60 described above is merely one example, and may be understandably other shapes described in other embodiments.

As described above, in this embodiment, the conductor 20 has one side and the insulator 30 that includes the core 32 and is more plastically deformable than the conductor 20 is disposed on the one side of the conductor 20. Thus, the conducting wire 10 can be kept in an arbitrary shape, so that the versatility is improved.

The insulator 30 includes the first adhesive 31 and the first adhesive 31 is adhered to the conductor 20. The conductor 20 and the insulator 30 can become one member by being separately prepared and then joined together. Thus, the conductor 20 does not necessarily contain a binder or a dispersant, and a resistance of the conductor 20 is thereby reduced. That is, it is possible to use a conductor having an optimal orientation according to applications or a conductor having low resistance. Therefore, the versatility is further improved.

Other Embodiments

The present disclosure is not limited to the above-described embodiments and may be appropriately modified.

In the first embodiment, the conductor 20 is not necessarily made of carbon nanotubes and may be made by molding a crashed graphite into a sheet and orienting the sheet.

In the first embodiment, the insulator 30 may be joined to the conductor 20 such that one end of the insulator 30 in the width direction protrude from the conductor 20. That is, the other end of the insulator 30 in the width direction may be joined to the conductor 20. The insulator 30 may have the same length in the width direction with the conductor 20 and the both ends of the insulator 30 in the width direction does not necessarily protrude from the conductor 20.

In the first embodiment, the first adhesive 31 and the second adhesive 33 may be made of a thermosetting adhesive. The first adhesive 31 and the second adhesive 33 may be heated and thermoset after the conducting wire 10 is formed or the conducting wire 10 is disposed in the stator core 61 and the like. As a result, a shape of the conducting wire 10 can be stabilized.

In the first embodiment, the conducting wire 10 does not necessarily include the second adhesive 33. In this case, when the conducting wire 10 is mounted in a member, an adhering member such as an adhesive may be disposed between the conducting wire 10 and the member.

The conducting wire 10 in the fifth embodiment likely defines a gap therein, thus autoclave treatment or resin impregnation may be performed to fill the gap. Similarly in other embodiments, gaps in the conducting wire 10 may be filled.

The conducting wire 10 in the seventh embodiment may include the supporter without removing the supporter. In this case, the conducting wire 10 may define the hollow space 50 therein by using a tubular member defining a hollow space as the supporter.

What is claimed is:

1. A conducting wire comprising:

a conducting wire element including:

a conductor made of carbon as a main component and extending along a longitudinal direction; and an insulator connected to the conductor and extending along the longitudinal direction, wherein the insulator includes:

a core made of a material that is more plastically deformable than the conductor; and a first adhesive made of an insulating material, disposed on one side of the core, and joined to the conductor, the insulator further includes a second adhesive made of an insulating material and disposed on the other side of the core opposite to the conductor, a direction perpendicular to both the longitudinal direction and a stacking direction in which the conductor and the insulator are stacked with each other is defined as a width direction, and the first adhesive, the second adhesive, and the core have a same length in the width direction such that the insulator has a width greater than that of the conductor whereby both side ends of the insulator protrude from the conductor in the width direction.

2. The conducting wire according to claim 1, wherein the conducting wire element is folded back, together with the conductor, along the longitudinal direction, and a first part of the conductor and a second part of the conductor is overlapped with each other so that the first part is in contact with the second part.

3. The conducting wire according to claim 1, wherein the conducting wire element is repeatedly folded back a plurality of times along the longitudinal direction.

4. The conducting wire according to claim 1, wherein the conducting wire element are two conducting wire elements, and the two conducting wire elements are stacked with each other such that the conductor of each of the two conducting wire elements is in contact with each other.

5. The conducting wire according to claim 1, wherein the conducting wire element are a plurality of conducting wire elements, and the plurality of conducting wire elements are stacked with each other in a same direction such that the insulator of upper one of adjacent ones of the conducting wire elements is in contact with the conductor of lower one of the adjacent ones of the conducting wire elements.

6. The conducting wire according to claim 1, wherein the conducting wire element is wound around an axis along a direction intersecting the longitudinal direction.

7. The conducting wire according to claim 6, wherein the conducting wire element defines a hollow space therein.

8. A coil member comprising:

a plurality of wound portions that are adjacent to each other; and the conducting wire according to claim 1, wherein the conducting wire is wound around the plurality of wound portions to constitute a plurality of coils, and a portion of the conducting wire serves as a connecting wire that connects adjacent ones of the plurality of coils.

9. The conducting wire according to claim 1, wherein, in an unfolded state of the conducting wire element:

the other side of the core on which the second adhesive is disposed is opposite in the stacking direction to the one side of the core on which the first adhesive is disposed;

the second adhesive, the core, the first adhesive, and the conductor are stacked in this order; and the both side ends of the insulator protrude from respective both opposite side ends of the conductor in the width direction.

10. The conducting wire according to claim 1, wherein, in an unfolded state of the conducting wire element:

the both side ends of the insulator protrude as respective ear portions on respective both opposite side ends of the conductor in the width direction.

* * * * *